United States Patent [19]

Rotman et al.

[11] 4,135,185

[45] Jan. 16, 1979

[54] RF LOOP INTRUDER DETECTION SYSTEM

[75] Inventors: Walter Rotman, Brighton; J. Leon Poirier, Chelmsford; Nicholas V. Karas, Lowell; Peter R. Franchi, Winchester; Ronald L. Fante, Reading, all of Mass.

[73] Assignee: The United States of America as represented by the Secretary of the Air Force, Washington, D.C.

[21] Appl. No.: 840,355

[22] Filed: Oct. 7, 1977

[51] Int. Cl.[2] ..... G08B 13/18

[52] U.S. Cl. ..... 340/552; 343/5 PD

[58] Field of Search ..... 340/552, 553; 343/5 PD

[56] References Cited

U.S. PATENT DOCUMENTS

| | | | |
|---|---|---|---|
| 3,696,368 | 10/1972 | Kauffman | 340/552 |
| 3,794,992 | 2/1974 | Gehman | 340/552 |

*Primary Examiner*—Glen R. Swann, III

*Attorney, Agent, or Firm*—Joseph E. Rusz; George Fine

[57] ABSTRACT

An RF intruder system utilizes two concentric loops of wire spaced apart for a predetermined magnitude, either of which can transmit and/or receive electromagnetic energy. This area within the loops are to be protected against intrusion. Without intrusion, the received signal is steady. Upon intrusion, there are signal changes which are instantly noted by signal detection and processing.

4 Claims, 7 Drawing Figures

RF LOOP INTRUDER DETECTION SYSTEM

STATEMENT OF GOVERNMENT INTEREST

The invention described herein may be manufactured and used by or for the Government for governmental purposes without the payment of any royalty thereon.

BACKGROUND OF THE INVENTION

The invention relates to a radio frequency (RF) system whose controlled electromagnetic fields are monitored by electronic devices which indicate any disturbances to the fields caused by an unauthorized intrusion. There is thus provided a means of protecting high value isolated resources from unwanted physical presence therein. The resources to be protected range from physical structures such as buildings, vehicles and planes to zones of space (temporary airfields and storage areas).

The prior art for protection against intrusion isolated resources had limitations as to the extent of the discrimination provided. The present invention uses VHF frequencies to obtain a strong perturbation from human intruders. It also makes possible discrimination against nuisance alarms from small animals and birds. It further eliminates the loss of sensitivity due to changing environmental conditions. Finally, the use of two concentric cables restricts the protected zone to preselected shapes such as torroidal.

SUMMARY OF THE INVENTION

A RF intruder detection system is provided for protecting isolated resources from unwanted physical intrusions. VHF (very high frequency) frequencies are used to discriminate against alarms. The VHF frequencies obtain strong perturbations for human intruders. The detection system uses two concentric sensor cables (wires) to restrict the protected zone which includes the aforementioned isolate resources. The two approximately concentric loops of wire are spaced about two to eight feet apart, either of which can transmit and/or receive electromagnetic energy. There is thus created a controlled electromagnetic field which may be monitored by appropriate electronic devices which indicate any disturbance to change in fields caused by an unauthorized physical intrusion.

DETAILED DESCRIPTION OF THE PREFERRED EMBODIMENTS

The RF loop intruder detection system is comprised of two approximately concentric loops of wire (cable) spaced about two to eight feet apart either of which can transmit and/or receive electromagnetic energy. Wire is defined to include bare or insulated wire above, on, or in the ground including several types of leaky coaxial cables. There is also included in the system detecting and processing equipment for the aforementioned electromagnetic energy.

Figure 1B:
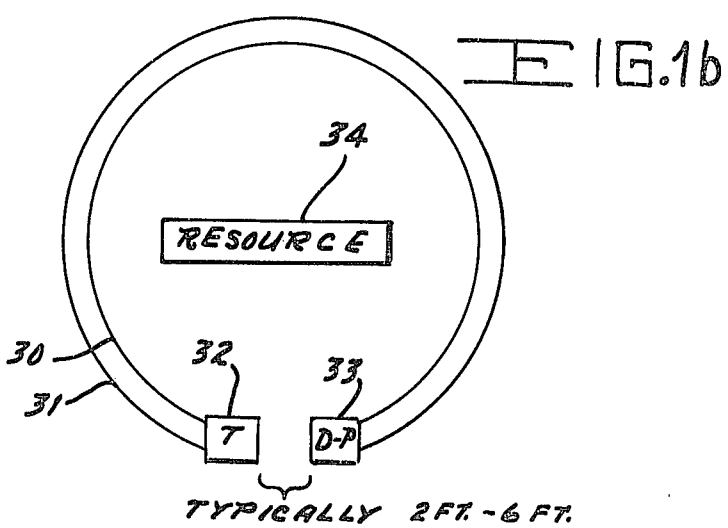
FIGS. 1*a* through 1*d* show four loop configurations.
Figure 1D:
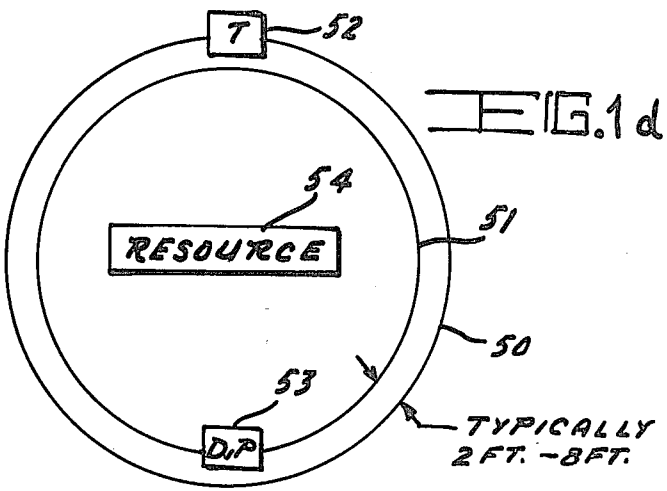
Figure 1A:
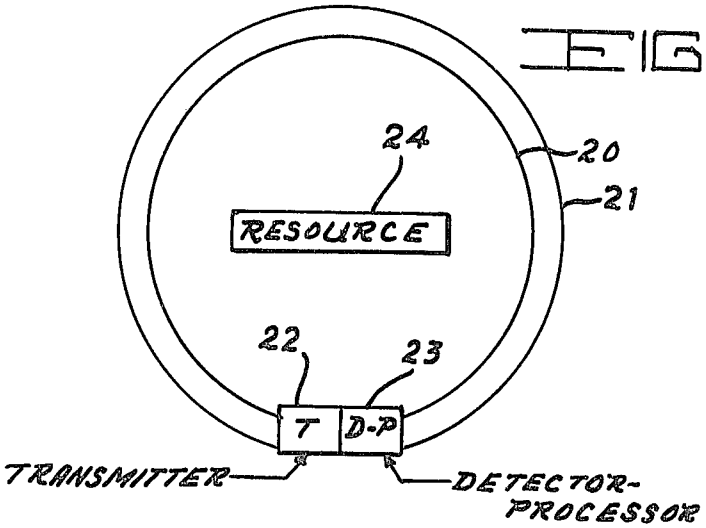
Figure 1C:
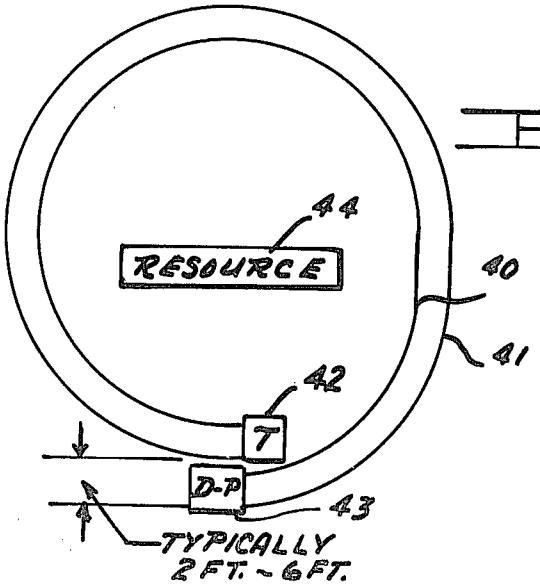

In operation, the sensor cables (wires) and the transmitting, detecting, and processing apparatus can be interconnected in various ways. FIGS. 1*a* through 1*d* shows four configurations indicative of the flexibility of the system. FIG. 1*a* shows cables 20 and 21 which may be separated by about two to eight feet. Transmitter 22 is utilized to feed electromagnetic energy to one of the cables and detector-processor 23 is used to detect and process the electromagnetic field that is picked up by the other cable. Resource 24 is to be protected against intrusion. As shown, the transmitter and detector-processor may be in one entity. FIG. 1*b* shows two cables 30 and 31 also separated by about 2 to 8 feet. Transmitter 32 is separated from detector-processor 33. Transmitter 32 feed electromagnetic energy to one cable and detector-processor 33 receives the resulting electromagnetic field. Resource 34 is to be protected against intrusion. FIG. 1*c* illustrates two cables 40 and 41, also separated by about two to eight feet. The cables show a different configuration protecting resource 44. Transmitter 42 feeds electromagnetic energy to one cable and detector-processor 43 receives electromagnetic field energy from the other cable. FIG. 1*d* shows two cables 50 and 51 separated by about 2 to 8 feet. Transmitter 52 feeds cable 50 and detector-processor 51 is fed electromagnetic field energy by way of cable 51. Resource 54 is to be protected against intrusion.

Figure 2:
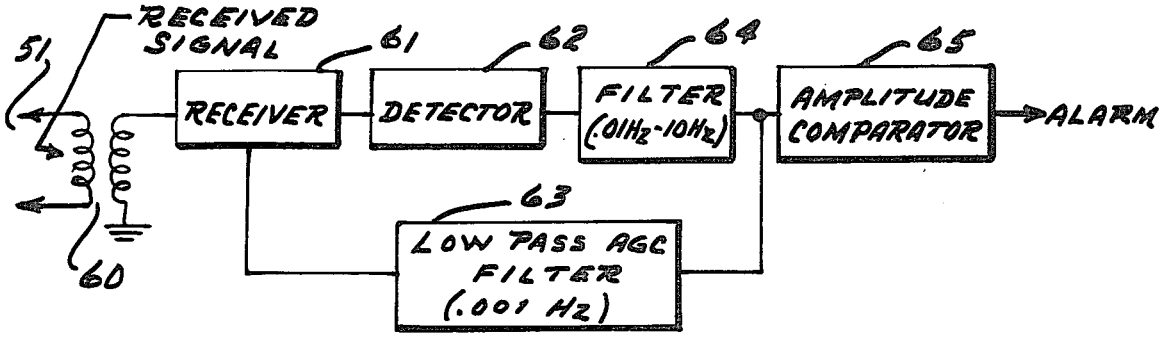
FIG. 2 shows in schematic form signal detecting and processing apparatus for the loop configurations.

The system can be used in the VHF frequency range (approximately 30 MHz – 300 MHz) and can be energized by either CW, AM or long pulse RF signals. One signal and processing apparatus is shown in FIG. 2. Receiving cable 51 of FIG. 1*d* is connected through balun 60 to receiver 61. Detector 62 passes the received signal to filter 64 which operates as a bandpass, then into amplitude comparator 65 which is then fed to an alarm sounder if the received signal fluctuations exceed a preset threshold. The bandpass filter (typically 0.01Hz – 10Hz) eliminates the amplitude fluctuations which are caused by either "very slow" of "very fast" disturbances. (disturbances not caused by humans). It is noted that low pass AGC filter (0.001 Hz) adjusts the system for changes in ambient environmental conditions. It is connected back from detector 62 to receiver 61. When the system is operating under "intrusion free" condition, the received signal is steady and there is no output from the bandpass filter. An intrusion causes fluctuations which pass through the bandpass filter and if they exceed the threshold of the amplitude comparator, the alarm is tripped.

Figure 3:
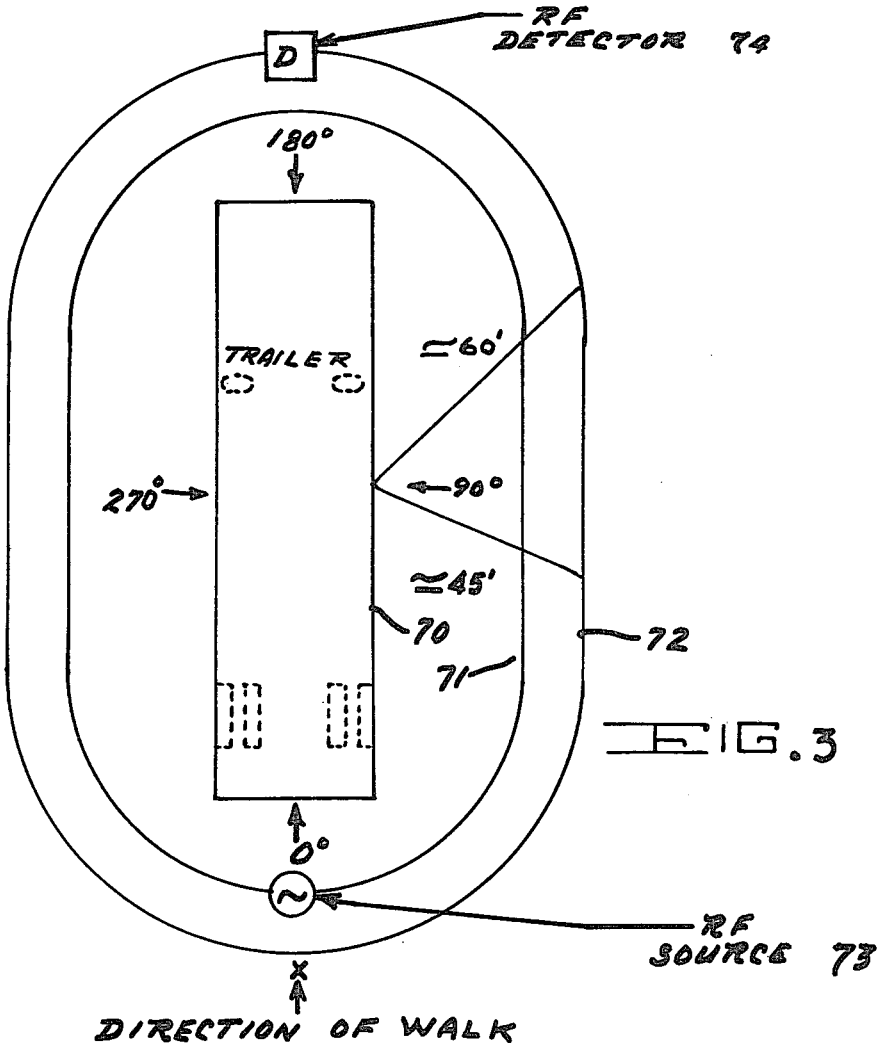
FIG. 3 shows one form of intrusion system including the resource to be protected in the form of a trailer.
Figure 4:
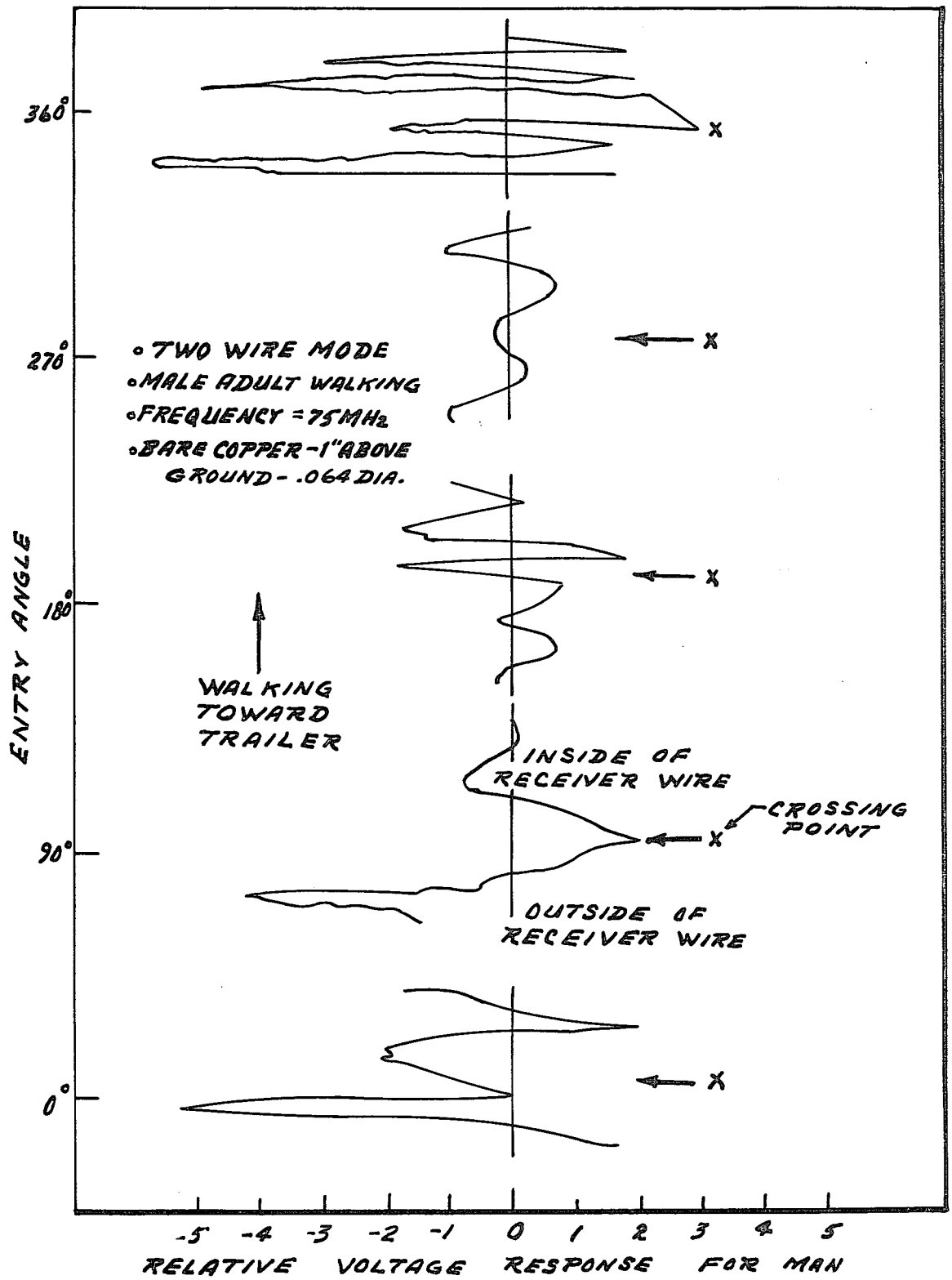
FIG. 4 shows the voltage response to a non walking in through the intrusion system.

FIG. 3 shows a schematic of the system protecting trailer (resource) 70 from intrusion. RF source 73 feeds electromagnetic energy in the form of RF to wire 71. Wire 72 receives the resulting electromagnetic field energy which is passed to detector 74 for further transmission if appropriate to a processor and an alarm. Wire 72 was bare copper, one inch above ground and 0.064 inch in diameter. Transmitter wire 71 and receiver wire 72 are concentric and may be spaced between 2 to 8 feet apart. Trailer 70, in this instance was metal and was 30 feet by 8 feet by 8 feet. A male adult walking rapidly toward trailer 70 at designated entry angles such as X attempted to intrude the zone of protection. The results are shown in FIG. 4. As seen, the system detected the intrusion at all entry angles in a measurable manner. The RF intruder detection system can be either mobile or permanent. For a permanent system, the preferred embodiment is to bury the wires, for a mobile system it can be deployed above or on the ground.

We claim:

1. An RF loop intruder detection system being comprised of two approximately concentric loops of wire surrounding a resource to be protected against human intrusion, said two concentric loops of wire spaced apart a predetermined magnitude, a transmitter feeding RF energy to one of said concentric loops of wire, indication means receiving RF energy from the other of said concentric loops of wire resulting from an electromagnetic field between said loops, and means connected to said indicating means for tripping an alarm upon predetermined change in the level of the received energy, as would be produced by said human intrusion.

2. An RF loop intruder detection system as defined in claim 1 wherein said indicating means is comprised of a detector.

3. An RF loop intruder detection system as defined in claim 1 wherein said indicating means is comprised of a balun, a receiver passing the output from said balun, a detector passing the receiver output, a bandpass filter receiving the detector signal, and an amplitude comparator passing the filtered signal for eventual sounding of an alarm upon exceeding a predetermined threshold voltage indicative of human intrusion.

4. An RF loop intruder detection system as described in claim 3 further including an AGC filter connected from the output of said detector to said receiver for adjusting for changes in ambient environmental conditions.

* * * * *